US005566541A

United States Patent [19]

Stahlecker et al.

[11] Patent Number: 5,566,541

[45] Date of Patent: Oct. 22, 1996

[54] OPENING ROLLER FOR AN OPEN-END SPINNING DEVICE

[75] Inventors: Fritz Stahlecker, Bad Ueberkingen; Karl-Josef Brockmanns, Willich, both of Germany

[73] Assignee: Fritz Stahlecker, Bad Uberkingen, Germany

[21] Appl. No.: 242,672

[22] Filed: May 13, 1994

[30] Foreign Application Priority Data

Jul. 13, 1993 [DE] Germany ..... 43 23 364.3

[51] Int. Cl.[6] ..... D01H 4/32

[52] U.S. Cl. ..... 57/408; 19/114

[58] Field of Search ..... 57/408, 409, 410, 57/411, 412, 413; 19/112, 114, 128

[56] References Cited

U.S. PATENT DOCUMENTS

| | | | |
|---|---|---|---|
| 2,937,412 | 5/1960 | Hollingsworth | 19/114 |
| 4,044,427 | 8/1977 | Ankrom et al. | 19/112 X |
| 4,291,437 | 9/1981 | Yoshizawa et al. | 57/408 X |
| 4,392,276 | 7/1983 | Gauvain et al. | 19/112 X |
| 4,805,395 | 2/1989 | Stahlecker et al. | 19/112 X |

FOREIGN PATENT DOCUMENTS

| | | | |
|---|---|---|---|
| 4024786 | 2/1992 | Germany . | |
| 489282 | 3/1955 | Italy | 19/114 |
| 1-92431 | 4/1989 | Japan | 57/408 |
| 2084619 | 4/1982 | United Kingdom | 57/408 |

*Primary Examiner*—Daniel P. Stodola

*Attorney, Agent, or Firm*—Evenson McKeown Edwards & Lenahan, PLLC

[57] ABSTRACT

An opening roller for an open-end spinning device is provided with a fitting of combing teeth. The fitting comprises zones with reduced, or entirely without, combing-out effect. The zones with reduced or entirely without combing-out effect are so designed and arranged relative to the combing teeth on the fitting that the fibers are combed out evenly of the sliver. A careful treatment of the fibers without a variation in yarn evenness is hereby achieved.

26 Claims, 5 Drawing Sheets

FIG. 2
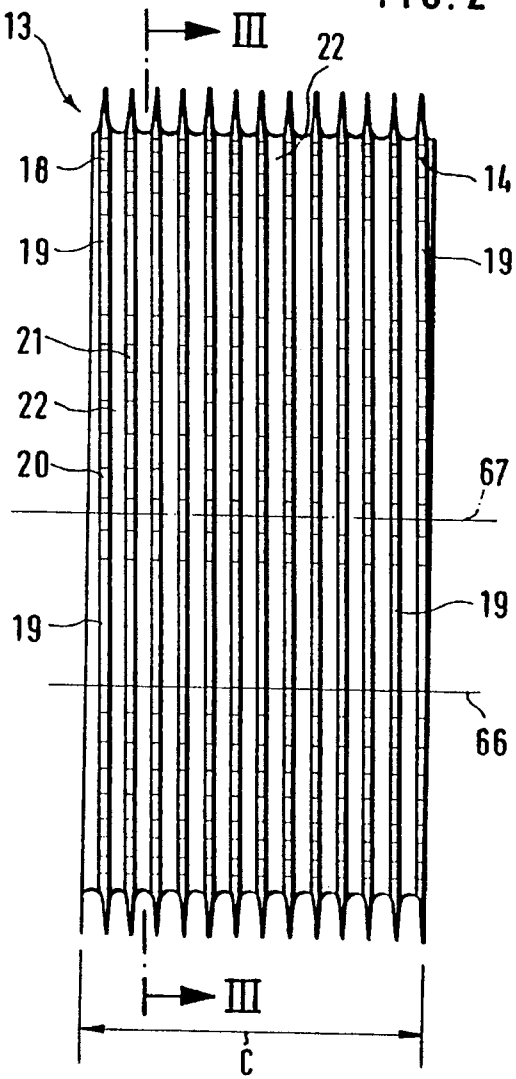
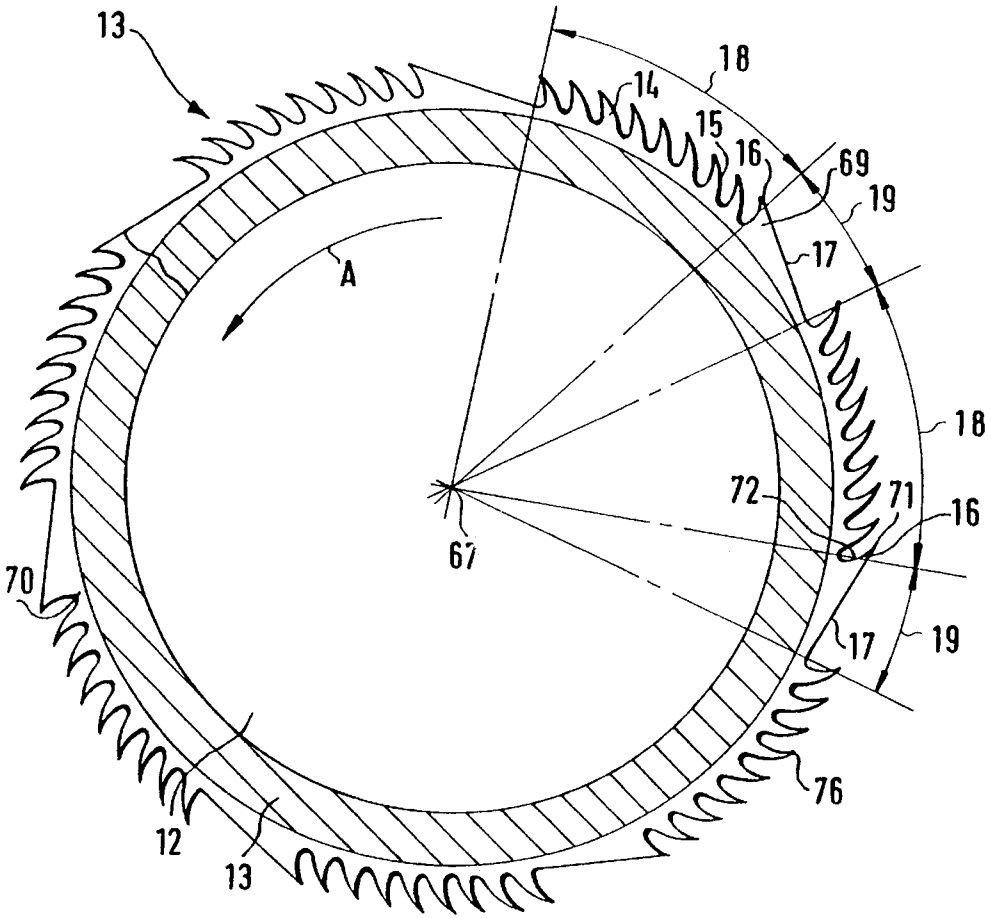
FIG. 3

OPENING ROLLER FOR AN OPEN-END SPINNING DEVICE

BACKGROUND AND SUMMARY OF THE INVENTION

The invention relates to an opening roller for an open-end spinning device with numerous combing teeth designed for combing out fibers out of a sliver, and which are arranged in numerous windings or ring-formed rows extending in circumferential direction of the opening roller, with at least a part of the helixes or ring-formed rows comprising zones with reduced combing effect or entirely without combing-out effect.

Usually opening rollers are provided with a fitting of combing teeth or combing needles in order to comb out fibers, which are to be spun into a yarn, from a fed-in sliver. The combing teeth are normally arranged on the opening roller in rows or helixes, extending in circumferential direction of the opening roller and with spaces between them, the spaces forming grooves.

On an opening roller to be used for the production of an even yarn, the combing teeth are uniformly made and arranged in rows or helixes equidistant from each other. Due to their contour, the combing teeth are suitable for combing out individual fibers from a fed-in sliver as soon as the fibers are released from the nipping line of the sliver feeding device. The combed-out fibers mainly reach the grooves formed by the rows or windings of the combing teeth and are taken along by the rotating opening roller to a fiber feed channel. Due to the prevailing under pressure there and to the effect of the centrifugal forces exerted by the opening roller, the fibers are released from the fitting and reach the fiber feed channel.

In order to generate the necessary centrifugal forces for the releasing of the fibers, the opening roller must rotate at a high number of revolutions. The fibers held at the nipping line are subject to numerous strokes from the combing teeth of the opening roller, the opening roller rotating at high speed, before they are released from the nipping line and combed out of the fiber beard by the combing teeth. The high number of strokes from the combing teeth lead frequently to mechanical damage of the fibers.

An opening roller having at least one discontinuity is known from the German patent application 40 24 786 A1. The discontinuity can consist in a zone without combing-out effect being provided in a row of combing teeth, or in a groove filled with an insert which thereby partly reduces the transport function of the opening roller.

The discontinuity is arranged on the fitting in such a way that, during the spinning process, varying amounts of fibers are fed into the fiber feed channel in order to be able to produce an uneven yarn.

An object of the invention is to manufacture an opening roller with which the mechanical stress of the fibers is reduced without giving rise to an uneven yarn.

This object is achieved in that the zones with reduced or entirely without combing-out effect are so designed and arranged relative to the combing teeth that the fibers are combed out of the sliver evenly.

The arrangement of zones with reduced or entirely without combing-out effect in place of combing teeth results in the number of strokes carried out on the fibers until their release from the nipping line being reduced. The number of combing teeth can be reduced by such an amount, and replaced by zones with reduced or entirely without combing-out effect, that the combing-out effect needed for the release of the necessary amount of fibers for spinning is just sufficient.

The design and arrangement of the zones with reduced or entirely without combing-out effect results in the more careful treatment of the fibers during combing-out from the sliver not having an effect on the evenness of the yarn. The spinning element can be continuously fed with a mainly constant amount of fibers. The grooves are maintained, so that the transport of the released fibers is not disturbed.

In an advantageous development, the zones with reduced or entirely without combing-out effect are arranged distributed over the axial width of the opening roller. A good evenness is hereby maintained during fiber release.

It is further advantageous to distribute the zones with reduced or entirely without combing-out effect evenly over the opening roller, namely over its axial width and/or in circumferential direction.

In an advantageous development, a zone with reduced or entirely without combing-out effect is so designed that it comprises at least one so-called "modified tooth", (whose function differs from that of a normal combing tooth), projecting from the opening roller. The modified tooth is so designed that it can transport fibers but has no, or only a reduced, combing-out effect. The modified teeth, projecting from the opening roller in place of the combing teeth, enable a careful treatment of the fibers during the combing-out process, and also the forming of grooves, which ensure an even transport of the released fibers.

In an advantageous development, the modified tooth projecting from the opening roller has the contour of a tooth whose face angle is smaller than that of a combing tooth. Due to the smaller face angle, a combing-out effect of the tooth is avoided or at least reduced.

In an advantageous development, a zone with reduced or entirely without combing-out effect is formed on the extended back of a combing tooth or a tooth with a smaller face angle. The tooth tip and the tooth face of the combing tooth form a zone with combing-out effect, while the area of the extended tooth back forms a projecting modified tooth, which is then part of a zone with reduced or entirely without combing-out effect.

In an advantageous development, the combing teeth and the radially projecting modified teeth together form a continuous wall in circumferential direction of the opening roller, whereby in the area of the zones with reduced or entirely without combing-out effect, the contour of the combing teeth and the contours of the invention are formed into the continuous wall.

Other objects, advantages and novel features of the present invention will become apparent from the following detailed description of the invention when considered in conjunction with the accompanying drawings.

BRIEF DESCRIPTION OF THE DRAWINGS

FIG. 2 is an enlarged top view of the circumferential side of a ring mounting of the opening device opening roller of FIG. 1;

FIG. 3 is a section along the line III—III of FIG. 2;

DETAILED DESCRIPTION OF THE PREFERRED EMBODIMENTS

Figure 1:
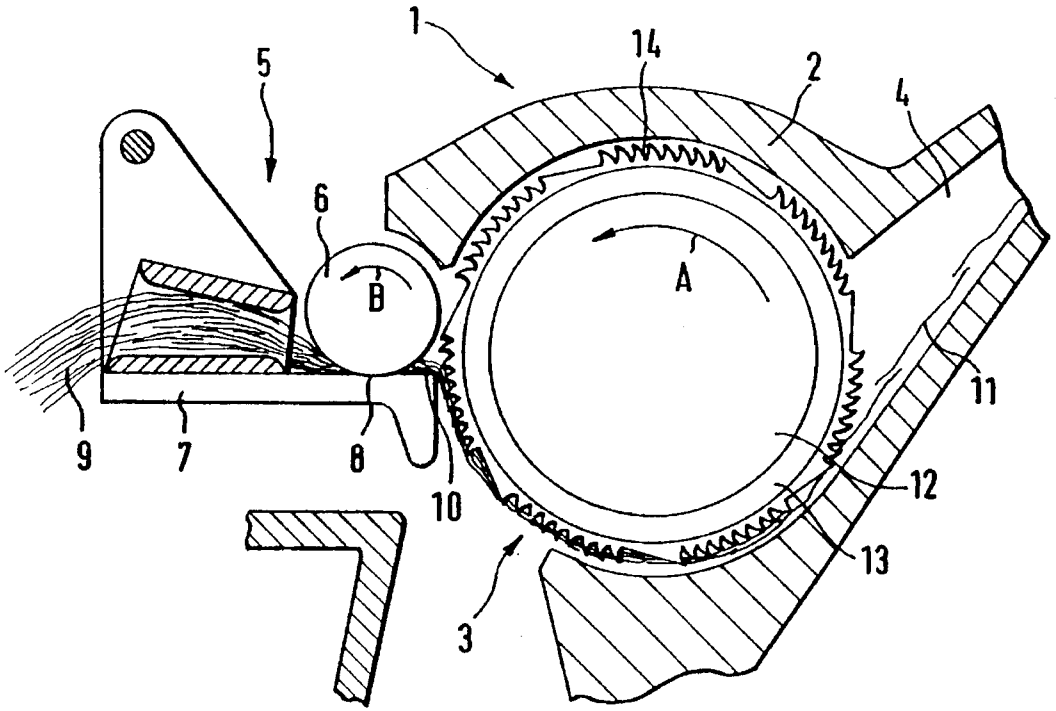
FIG. 1 is a sectional view of an opening device of an open-end spinning installation constructed according to a preferred embodiment of the invention.

The opening device 1 shown in FIG. 1 comprises mainly an opening roller 3 and an opening roller housing 2, which houses the opening roller 3 rotating in arrow direction A.

The opening roller 3 comprises a cylindrical base body 12 and a ring mounting 13 which is attached to the base body 12 and which carries a fitting with combing teeth 14 and contains zones 19 without combing-out effect (see FIG. 3), which will be explained at a further point.

A feeding device 5 for feeding a sliver 9 is arranged upstream from the opening roller 3. The feeding device 5 comprises mainly a feeding roller 6, which rotates in arrow direction B, and a feed table 7, the feeding roller 6 and feed table 7 together forming a nipping line 8 for the sliver 9.

The fibers of the continuously fed-in sliver 9, stuck fast at the nipping line 8, reach the opening roller 3 in the form of a fiber beard 10. As a result of the rotation of the feeding roller 6, individual fibers 11 are continuously released from the nipping connection at the nipping line 8 and picked up by the opening roller 3. The individual fibers 11 are forwarded by the opening roller 3 in rotation direction A to a fiber feed channel 4, where, due to the centrifugal forces exerted by the opening roller 3 and the prevailing suction in the fiber feed channel 4, the fibers 11 are released from the opening roller 3 and are transported through the fiber feed channel 4 to a spinning element (not shown).

As can be seen in FIGS. 2 and 3, the combing teeth 14 in circumferential direction of the opening roller 3 are so arranged one behind the other that they form coils 20, 21 which extend helically over the circumference of the ring mounting 13, covering substantially the entire axial width C. The opening roller 3 is somewhat wider than the ring mounting 13, as it comprises mounting elements (not shown) which, after assembly, lie on the base body 12 against the end wails of the ring mounting 13. Grooves 22 are formed between two neighboring helixes 20, 21.

The helixes 20 and 21 are distributed in zones 18 with combing-out effect and zones 19 without combing-out effect. Each zone 18 with combing-out effect comprises eight combing teeth 14, each with a short back 15, as well as the tooth tip 71 and the tooth face 72 of a combing tooth 16 with a long back 17. The long back 17 lies in the zone 19 without combing-out effect, the zone 19 following a zone 18 with combing-out effect. The area of the long back 17 of the combing tooth 16 has the form of a modified tooth projecting radially from the ring mounting 13, and thus forms the zone 19 without combing-out effect. The combing-out effect results from, among other factors, the incline of the tooth tips 71 and 76 of the combing teeth 14 and 16 in the rotation direction A of the opening roller 3.

The zones 18 with combing-out effect and the zones 19 without combing out effect are distributed evenly in circumferential direction of the opening roller 3. Each complete helix 20, 21 comprises six zones 18 with combing-out effect and six zones 19 without combing-out effect. The combing teeth 14 and the combing teeth 16 with the modified teeth 69 are connected integrally, so that a continuous, thin strip 70 extending in circumferential direction is formed which contains the contours of the combing teeth 14 and the combing teeth 16 integrally with the modified teeth 69.

As can be seen in particular in FIG. 3, the zones 18 with combing-out effect and the zones 19 without combing-out effect are distributed evenly over the entire axial width C of the ring mounting 13. The zones 18 with combing-out effect and the zones 19 without combing-out effect are each arranged along lines 66 which extend parallel to the axis 67.

Due to the even distribution of the zones 18 with combing-out effect and the zones 19 without combing-out effect, a regular combing out of the fibers 11 from the fiber beard 10 is effected, whereby the number of strokes carried out on the fibers 11 in the fiber beard 10 is reduced as a result of the zones 19 without combing-out effect.

As the grooves 22 between neighboring helixes 20 and 21 also include the areas of the zones 19 without combing-out effect, the transport of the released fibers 11 to the fiber feed channel 4 is guaranteed.

Figure 4:
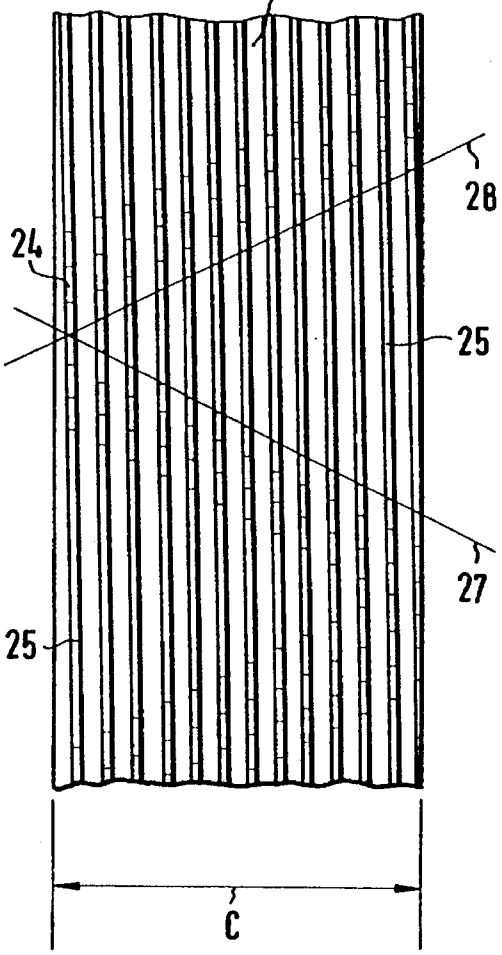
FIG. 4 is a partial view of the circumferential side of a ring mounting of an opening roller in another embodiment.

In FIG. 4, another distribution possibility of the zones 24 with combing-out effect and zones 25 without combing-out effect over the width C of a ring mounting 26 is shown, which differs from the arrangement in FIG. 2. The zones 25 without combing-out effect are arranged in the direction of width C of the ring mounting 26 within the lines 27, 28, the lines extending with a direction component in axial direction and in circumferential direction of the opening roller 3. The lines 27 and 28 are, for reasons of simplification, shown drawn straight, as though the ring mounting 26 does not take a curved course, but rather a straight one.

Figure 5:
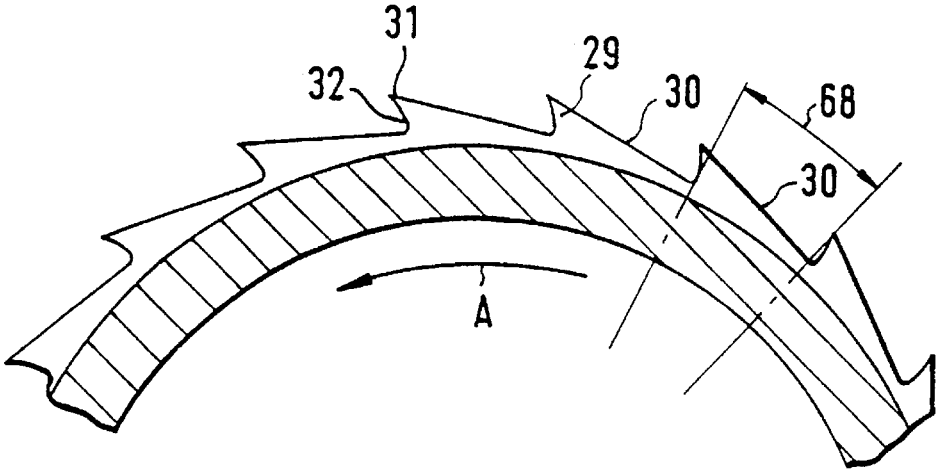
FIG. 5 is a section partial view, similar to FIG. 3, of a ring mounting of an opening roller in another embodiment.

In the embodiment in FIG. 5, only teeth 29 with long backs 30 are shown on the ring mounting. The zones 68 without combing-out effect are formed here by the long backs 30, while the zones with combing-out effect are formed by the tooth tips 31 and the tooth faces 32 of the combing teeth 29.

Figure 6:
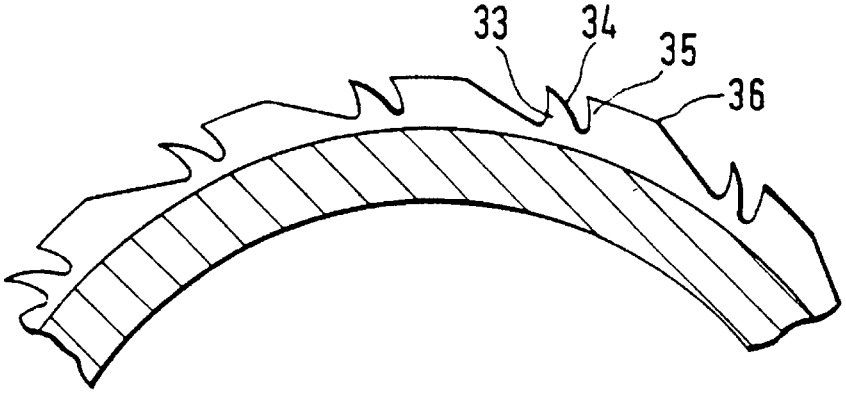
FIG. 6 is a partial view, similar to FIG. 5, of a ring mounting of an opening roller in another embodiment.

In the embodiment shown in FIG. 6, a combing tooth 33 with a short back 34 and a combing tooth 35 with a long back 36 are arranged alternately in circumferential direction behind each other. The zones without combing-out effect are also formed here by the long backs 36.

Figure 7:
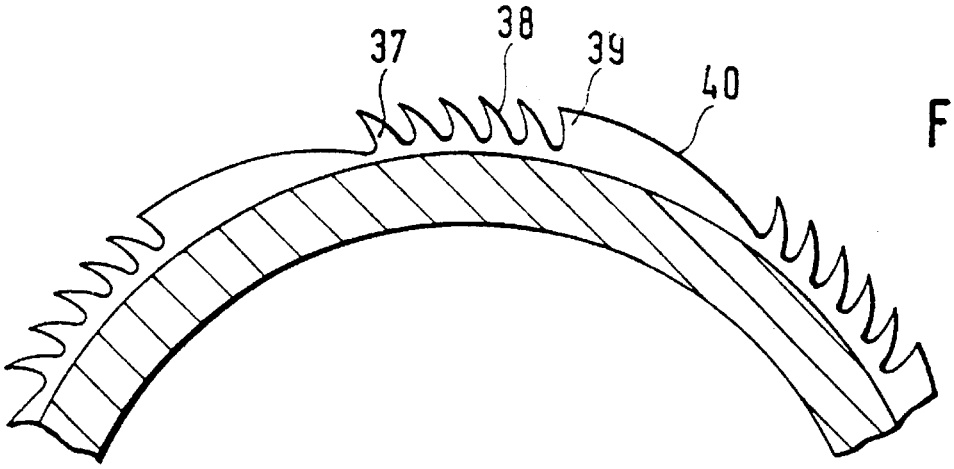
FIG. 7 is a partial view, similar to FIG. 5, of a ring mounting of an opening roller in another embodiment.

In the embodiment shown in FIG. 7, after each group of five combing teeth 37 with short backs 38, a single combing tooth 39 with a long back 40 is arranged in circumferential direction. The long back 40 of the combing tooth 39 has the same direction of curvature as the opening roller 3, whereby the radius of curvature of the long back 40 is smaller than the radius of curvature of the opening roller 3.

Figure 8:
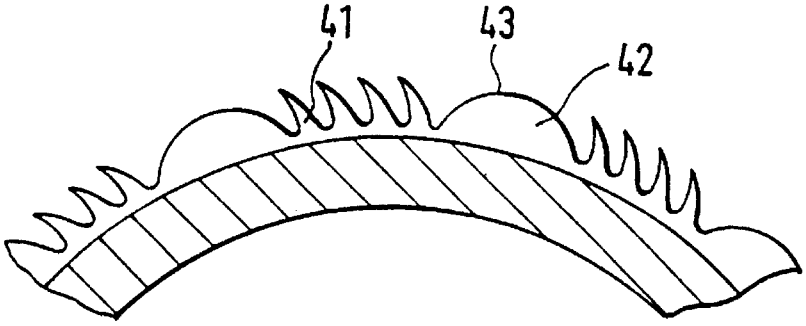
FIG. 8 is a partial view, similar to FIG. 5, of a ring mounting of an opening roller in another embodiment.

In the embodiment shown in FIG. 8, a modified tooth 42, projecting radially from the opening roller 3, is provided after each group of four combing teeth 41, the modified teeth each forming a zone without combing-out effect. The modified teeth 42 have the contour of a segment of a circle whose curved circumferential edge 43 borders the modified tooth 42 in radial direction of the opening roller 3.

Figure 9:
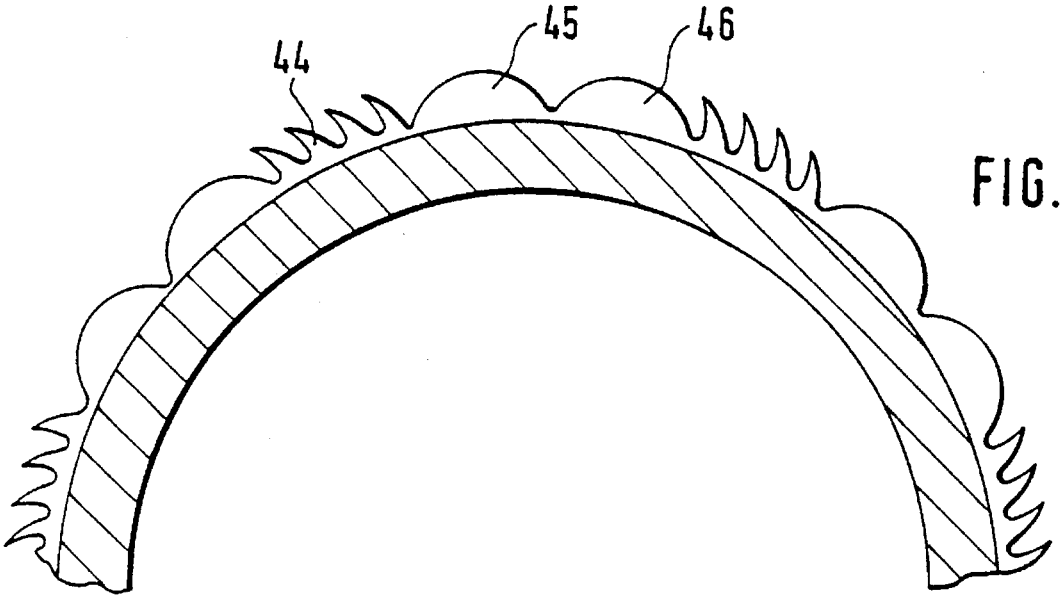
FIG. 9 is a partial view, similar to FIG. 5, of a ring mounting of an opening roller in another embodiment.

In the embodiment of FIG. 9, two radially projecting modified teeth 45, 46 are arranged in circumferential direction of the opening roller 3 after each group of four combing teeth 44, the modified teeth having the same contour as the modified teeth in FIG. 8 and forming together a zone without combing-out effect.

Figure 10:
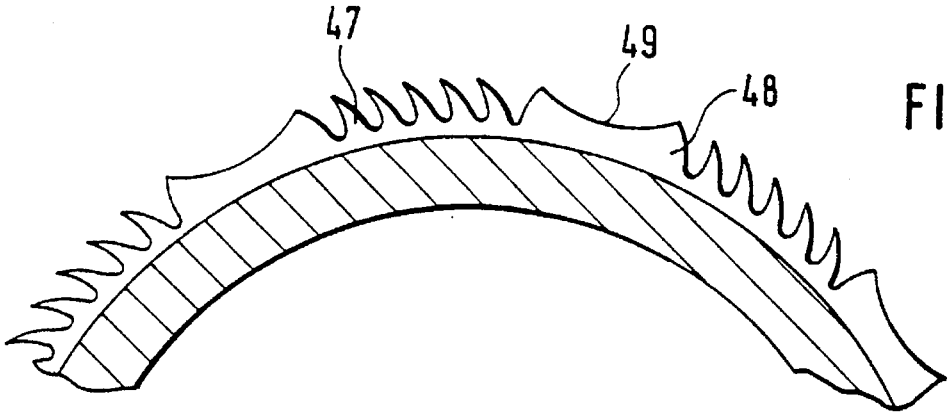
FIG. 10 is a partial view, similar to FIG. 5, of a ring mounting of an opening roller in another embodiment.

In the embodiment shown in FIG. 10, a radially projecting modified tooth 48 is arranged in circumferential direction of the opening roller 3 after each group of five combing teeth 47, the modified tooth being limited in its radial extension by an edge 49, curving in the opposite direction to the direction of curvature of the opening roller 3. The radially projecting modified tooth 48 forms a zone without combing-out effect.

Figure 11:
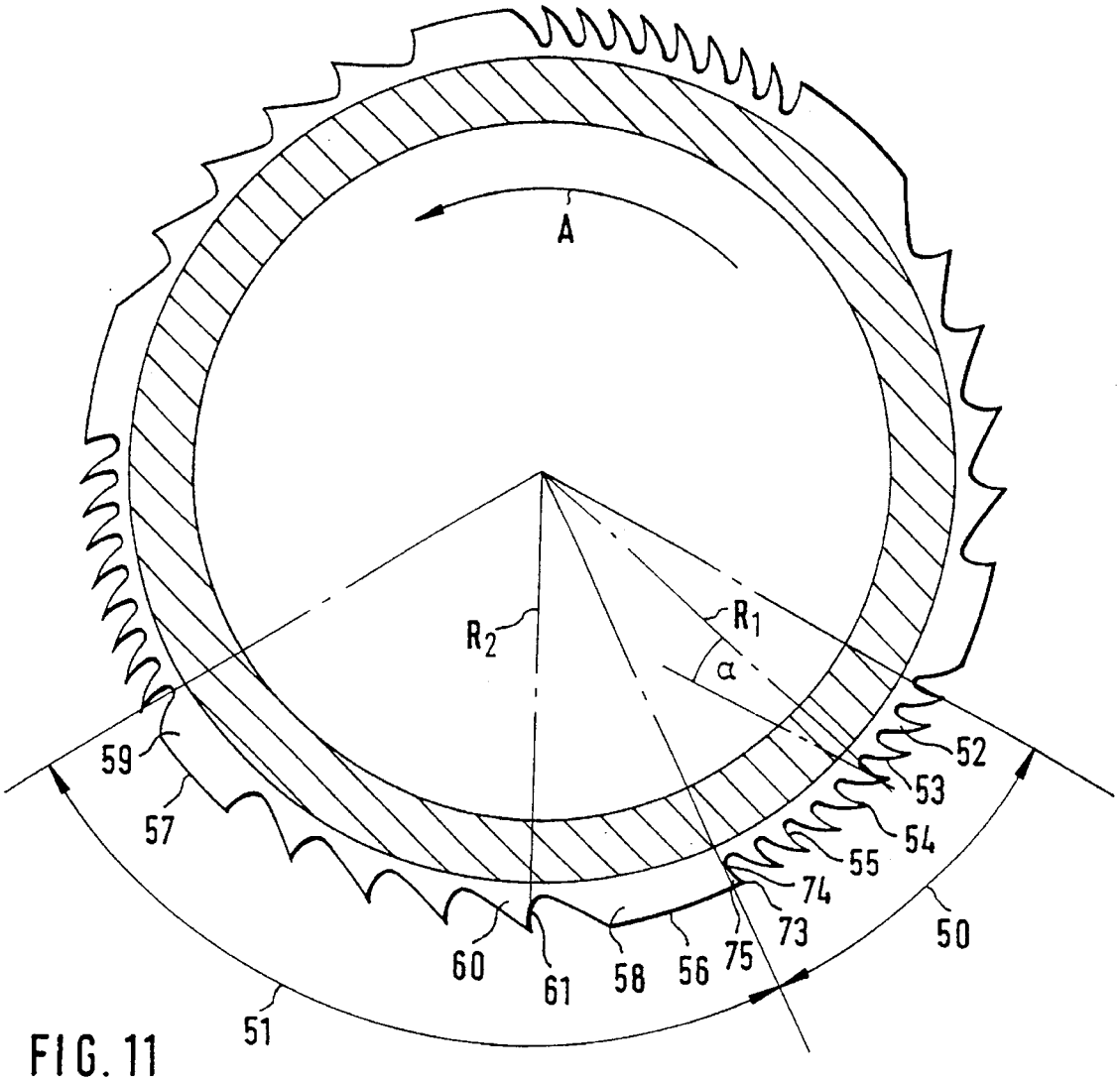
FIG. 11 a view, similar to FIG. 3, of a ring mounting of an opening roller in another embodiment.

In the embodiment shown in FIG. 11, zones 50 with combing-out effect and zones 51 without combing-out effect, or with reduced combing-out effect, are distributed evenly in circumferential direction on the opening roller 3. A zone 50 with combing-out effect each comprises eight combing teeth 52 with a short back 53 as well the tooth tip 73 and tooth face 74 of a combing tooth 75 with a long back 56. This long back 56 forms the edge of a modified tooth 58 projecting from the opening roller 3. The tooth tips 53, 73 are both inclined in circumferential direction of the opening roller 3, so that the tooth faces 55 and 74 form, together with the radial line R1, a face angle α.

The zone 51 comprises the radially projecting modified teeth 58, 59 and 60 and contains areas with combing-out effect and areas with reduced combing-out effect. The edges 56, 57 of the modified teeth 58, 59 have absolutely no combing-out effect. The teeth of the modified teeth 60 have a reduced combing-out effect. The tooth face 61 of each tooth 60 is not inclined in the sense of direction A of the opening roller 3, but rather extends in the direction of the radial line R2, so that the face angle is zero.

Figure 12:
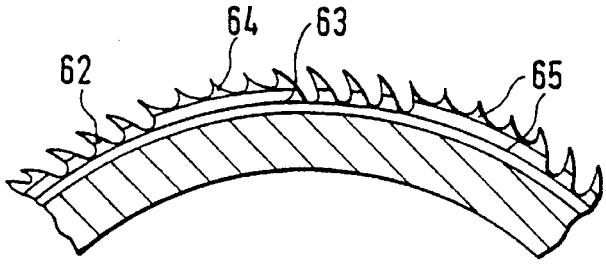
FIG. 12 is a partial view, similar to FIG. 5, of an opening roller in another embodiment.

In the embodiment shown in FIG. 12, a radially projecting modified tooth 63 with short teeth 64 is arranged after each group of three combing teeth 62, whereby the modified tooth 63 forms a zone with reduced combing-out effect. The short teeth 64 differentiate from the combing teeth 62 in that the short teeth 64 have a shorter tooth face and a shorter tooth back, so that the tooth base is relatively near to the tooth tip. The short teeth 64 have a considerably reduced combing-out effect in comparison to the combing teeth 62. The lateral surfaces of the combing teeth 62 and of the radially projecting modified tooth 63 are provided with a surface structure in the form of grooves which extend in circumferential direction. The taking along of the combed-out fibers 11 from the sliver 9 is hereby improved.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An opening roller for an open-end spinning device comprising:

a rotatable roller body having a roller body rotational axis, and combing teeth arranged in a predetermined pattern over a circumferential area of said roller body and serving to comb out fibers from a supplied sliver when said roller body is rotatably driven, said predetermined pattern including a plurality of axially spaced apart circumferentially extending rows of radially extending combing teeth, wherein each of said rows includes a plurality of full combing effect teeth and a plurality of reduced combing effect teeth, said reduced combing effect teeth including radially extending combing surfaces which are different than corresponding radially extending combing surfaces of said full combing effect teeth to thereby form zones of reduced combing effect as compared to zones formed by said full combing effect teeth, said zones of reduced combing effect serving to minimize damage to fibers combed from the sliver by the opening roller, wherein the maximum radial extent of said reduced combing effect teeth is less than the maximum radial extent of said full combing effect teeth, wherein said zones of reduced combing effect are uniformly distributed over the circumferential area of said roller body so that fibers are evenly combed out of said sliver by said combing teeth, and wherein the zones with reduced combing effect include a zone which comprises at least one modified tooth, said modified tooth having a predetermined contour projecting radially from the opening roller and extending in the circumferential direction.

2. An opening roller according to claim 1, wherein the zones of reduced combing effect are distributed evenly over the axial width of the opening roller.

3. An opening roller according to claim 2, wherein the combing teeth and the at least one radially projecting modified tooth is formed by a continuous ringstrip extending in the circumferential direction, which integrally contains the contours of the radially projecting modified tooth and the combing teeth.

4. An opening roller according to claim 1, wherein the zones of reduced combing effect are arranged along at least one line, extending substantially axially with a component in circumferential direction of the opening roller.

5. An opening roller according to claim 1, wherein the zones of reduced combing effect are arranged on several places in circumferential direction of the opening roller.

6. An opening roller according to claim 5, wherein the zones of reduced combing effect are distributed evenly in circumferential direction of the opening roller.

7. An opening roller according to claim 6, wherein the zones with reduced combing effect include respective such zones arranged in circumferential direction after every combing tooth.

8. An opening roller according to claim 1, wherein the radially projecting modified tooth has the contour of a circle segment, the peripheral edge of said circle segment radially bordering the modified tooth and having a smaller radius of curvature than that of the opening roller.

9. An opening roller according to claim 1, wherein the radially projecting modified tooth has the contour of one or several teeth, said teeth having a smaller face angle than that of a combing tooth.

10. An opening roller according to claim 1 wherein the radially projecting modified tooth is radially bordered by an edge curving in the opposite direction of curvature to that of the opening roller.

11. An opening roller according to claim 1, wherein the combing teeth and the radially projecting modified teeth are formed by a continuous ringstrip extending in circumferential direction, which integrally contains the contours of the radially projecting modified tooth and the combing teeth.

12. An opening roller according to claim 1, wherein the combing teeth are provided with a surface structure on at least one lateral side.

13. An opening roller according to claim 1, wherein the zones of reduced combing effect are arranged along at least one line, extending substantially axially with a component in circumferential direction of the opening roller.

14. An opening roller according to claim 1, wherein the combing teeth and the at least one radially projecting modified tooth is formed by a continuous ringstrip extending in the circumferential direction, which integrally contains the contours of the radially projecting modified tooth and the combing teeth.

15. An opening roller according to claim 1, wherein said radially outer ends of the reduced combing effect teeth are all disposed radially inwardly of radial outer ends of the full combing effect teeth.

16. An opening roller according to claim 15, wherein said combing teeth are provided on a thin strip extending in helical coils around the roller body with circumferential helical grooves between adjacent helical coils.

17. An opening roller according to claim 1, wherein said combing teeth are provided on a thin strip extending in helical coils around the roller body with circumferential helical grooves between adjacent helical coils.

18. An opening roller for an open-end spinning device comprising:

a rotatable roller body having a roller body rotational axis, and combing teeth arranged in a predetermined pattern over a circumferential area of said roller body and serving to comb out fibers from a supplied sliver when said roller body is rotatably driven, said predetermined pattern including a plurality of axially spaced apart circumferentially extending rows of radially extending combing teeth, wherein each of said rows includes a plurality of full combing effect teeth and a plurality of reduced combing effect teeth, said reduced combing effect teeth including radially extending combing surfaces which are different than corresponding radially extending combing surfaces of said full combing effect teeth to thereby form zones of reduced combing effect as compared to zones formed by said full combing effect teeth, said zones of reduced combing effect serving to minimize damage to fibers combed from the sliver by the opening roller, wherein the maximum radial extent of said reduced combing effect teeth is less than the maximum radial extent of said full combing effect teeth, wherein said zones of reduced combing effect are uniformly distributed over the circumferential area of said roller body so that fibers are evenly combed out of said sliver by said combing teeth, and wherein the zones with reduced combing effect include a zone comprising a back of a combing tooth or a tooth with a smaller face angle, whereby the back is extended in the circumferential direction of the opening roller.

19. An opening roller according to claim 18, wherein the extension of the extended back in circumferential direction is at least double that of the nonextended back of a combing tooth.

20. An opening roller according to claim 19, wherein the extended back extends to the base of the next combing tooth in circumferential direction.

21. An opening roller according to claim 20, wherein the extended back has an area which curves in the same direction of curvature as the opening roller.

22. An opening roller according to claim 21, wherein the radius of curvature of the curved area is smaller than the radius of curvature of the opening roller.

23. An opening roller according to claim 18, wherein the extended back extends to the base of the next combing tooth in circumferential direction.

24. An opening roller according to claim 18, wherein the extended back has an area which curves in the same direction of curvature as the opening roller.

25. An opening roller according to claim 24, wherein the radius of curvature of the curved area is smaller than the radius of curvature of the opening roller.

26. An opening roller according to claim 18, wherein the combing teeth are provided with a surface structure on at least one lateral side.

* * * * *

UNITED STATES PATENT AND TRADEMARK OFFICE

CERTIFICATE OF CORRECTION

PATENT NO. : 5,566,541

DATED : October 22, 1996

INVENTOR(S) : Fritz Stahlecker and Karl-Josef Brockmanns

It is certified that error appears in the above-indentified patent and that said Letters Patent is hereby corrected as shown below: On the title page: Item [73]

Please designate the Assignees to be:

Fritz Stahlecker
Josef-Neidhart-Strasse 18
73337 Bad Ueberkingen, Germany

Hans Stahlecker
Haldenstrasse 20
73079 Suessen, Germany

W. Schlafhorst AG & Co.
Blumenberger Strasse 143-145
41061 Moenchengladbach, Germany Signed and Sealed this Sixteenth Day of September, 1997

*Attest:*

BRUCE LEHMAN

*Attesting Officer*

*Commissioner of Patents and Trademarks*